US009359563B2

(12) United States Patent
Standing

(10) Patent No.: US 9,359,563 B2
(45) Date of Patent: Jun. 7, 2016

(54) HYDROPROCESSING INITIALIZING PROCESS AND APPARATUS RELATING THERETO

(71) Applicant: UOP, LLC, Des Plaines, IL (US)

(72) Inventor: Christopher Lepine Standing, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 365 days.

(21) Appl. No.: 13/863,068

(22) Filed: Apr. 15, 2013

(65) Prior Publication Data

US 2014/0309465 A1 Oct. 16, 2014

(51) Int. Cl.
*C10G 65/12* (2006.01)
*C10G 47/36* (2006.01)

(52) U.S. Cl.
CPC ..... *C10G 65/12* (2013.01); *C10G 47/36* (2013.01); *C10G 2300/4031* (2013.01)

(58) Field of Classification Search
CPC ..... C10G 65/12; C10G 2300/4006
See application file for complete search history.

(56) References Cited

U.S. PATENT DOCUMENTS 3,308,054 A * 3/1967 Duir et al. ..... 208/89
3,622,501 A * 11/1971 Bertolacini et al. ..... 208/111.15
4,935,120 A * 6/1990 Lipinski et al. ..... 208/59
5,002,752 A 3/1991 Lee et al.
5,110,444 A 5/1992 Haun et al.
5,114,562 A 5/1992 Haun et al.
5,980,729 A 11/1999 Kalnes et al.
6,190,535 B1 2/2001 Kalnes et al.
6,296,758 B1 10/2001 Kalnes et al.
6,623,623 B2 9/2003 Kalnes
7,087,546 B2 8/2006 Eijsbouts et al.
7,276,215 B2 10/2007 Mueller
7,794,585 B2 9/2010 Leonard et al.
7,906,013 B2 3/2011 Kokayeff et al.
7,956,000 B2 6/2011 Jansen et al.
8,008,534 B2 8/2011 Petri et al.
8,062,509 B2 11/2011 Serban et al.
8,221,706 B2 7/2012 Petri et al.
2002/0004533 A1 1/2002 Wallace et al.
2012/0248011 A1 10/2012 Wieber

FOREIGN PATENT DOCUMENTS

WO 2004041426 5/2004

* cited by examiner

*Primary Examiner* — Prem C Singh
*Assistant Examiner* — Juan Valencia
(74) *Attorney, Agent, or Firm* — James C. Paschall

(57) ABSTRACT

One exemplary embodiment can be a process for initializing hydroprocessing. Generally, the process can include providing a hydrocarbon feed to a hydrotreating zone within which the hydrotreating temperature is catalytically limited, passing an effluent from the hydrotreating zone to a hydrocracking zone, and adding a gas to the effluent that has a higher temperature than the effluent. Thus, the temperature of the effluent may be raised, facilitating hydrocracking reactions within the hydrocracking zone.

10 Claims, 1 Drawing Sheet

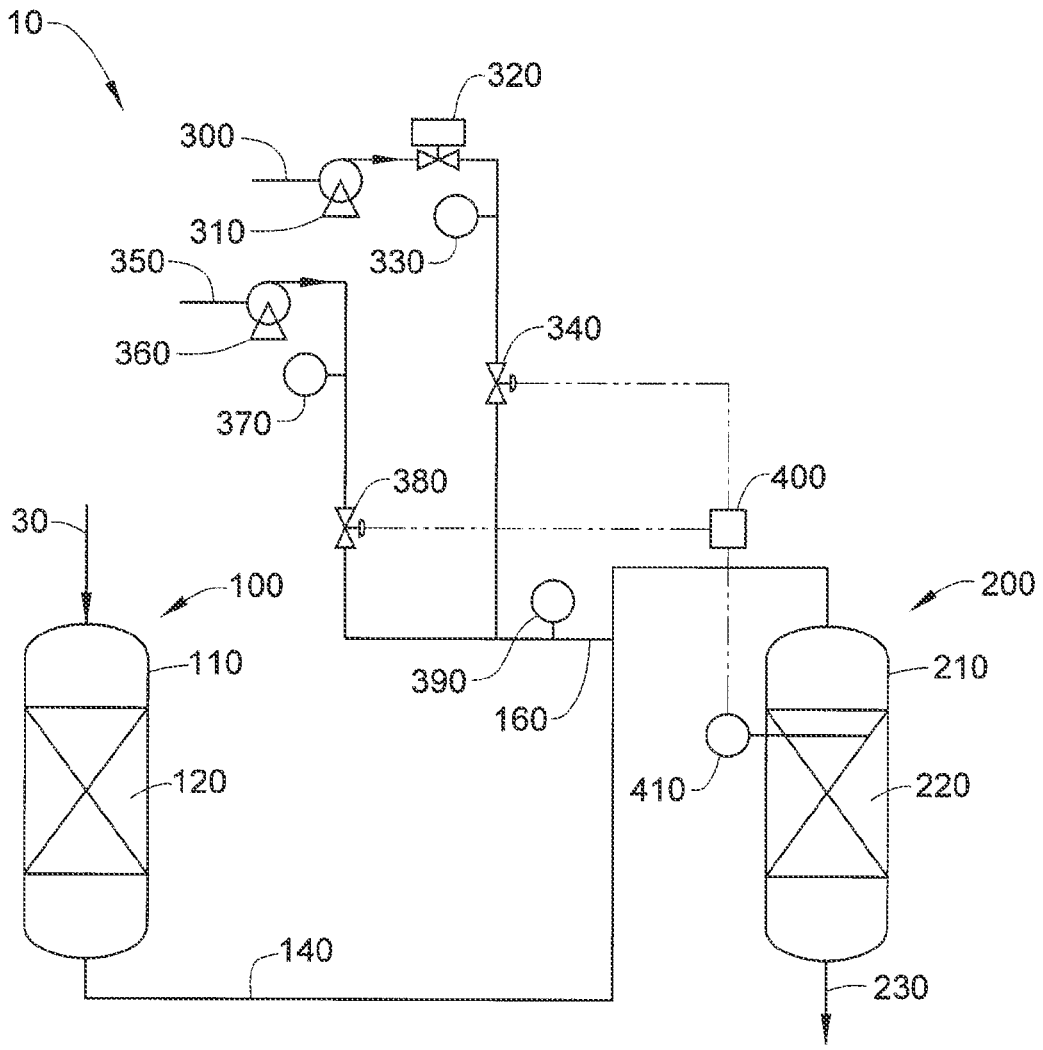
10
320
300
310
330
350
360
340
370
380
400
30
100
200
110
390
160
210
120
410
220
140
230

HYDROPROCESSING INITIALIZING PROCESS AND APPARATUS RELATING THERETO

FIELD OF THE INVENTION

This invention generally relates to an initializing process and an apparatus relating thereto.

DESCRIPTION OF THE RELATED ART

A hydroprocessing unit can be comprised of a hydrotreating zone followed by a hydrocracking zone. During initializing of the hydroprocessing unit, the temperature of the catalyst bed or beds in the hydrotreating zone can be increased until impurities, such as organic nitrogen, passing through the zone may be eliminated or reduced to an acceptable level.

During initialization, the hydrotreating catalyst is very active. Often, the temperature of the hydrotreating zone has to be limited to about 390° C. or less to avoid alteration of the catalyst at least until the catalyst has established equilibrium. However, the hydrocracking zone may require a higher temperature for operation, so that this heat limitation can result in an operating and outlet temperature of the hydrotreating zone that may be lower than the required inlet temperature for the hydrocracking zone. A low hydrocracking inlet temperature may restrict the conversion of the hydrocracking zone and lower yield as the initial heat input for the hydrocracking beds is typically derived from the upstream hydrotreatment beds.

Eventually, the hydrotreatment catalyst bed temperature may be increased until the temperature of the downstream hydrocracking catalyst bed or beds in the hydrocracking zone may be increased to improve conversion. However, it can take a long time for some catalyst to reach equilibrium so the outlet temperature of the hydrotreating zone is no longer limited. This period is often about 21 days, and can be as long as 30-60 days. During this time the hydrocracking zone is prone to poor conversion and yield loss.

Sometimes, the hydrocracking reactor is run at severe conditions to overcome these problems; however, this is not a satisfactory solution as it can reduce the life of the hydrocracking reactor. Further, this start up restriction apparently has not yet been solved by catalyst design or selection.

To facilitate the heating of the hydrocracking catalyst beds due to the low hydrotreatment effluent temperatures, sometimes the quench to the hydrocracking beds is either reduced to a minimum or cut off during this initializing period. Operating the hydrocracking reactor without active quench, however, is not inherently safe with respect to the process and can lead to over conversion of catalyst activity loss. Accordingly, there is generally a need in the art for a method and apparatus that can adjust and maintain the hydrocracking zone to a higher temperature during initializing.

SUMMARY OF THE INVENTION

One exemplary embodiment can be a process for initializing hydroprocessing. Generally, the process can include providing a hydrocarbon feed to a hydrotreating zone within which the hydrotreating temperature is catalytically limited, passing an effluent from the hydrotreating zone to a hydrocracking zone, and adding a gas to the effluent that has a higher temperature than the effluent. Thus, the temperature of the effluent may be raised, facilitating hydrocracking reactions within the hydrocracking zone.

Another exemplary embodiment can be a process for hydroprocessing within about 60 days of initializing operations. The process can include providing a hydrocarbon feed to a hydrotreating zone to produce a hydrotreated effluent, and adding a hydrogen gas to the hydrotreated effluent. The hydrogen gas can raise the temperature of the hydrotreated effluent to a temperature sufficient to facilitate hydrocracking operations.

A further exemplary embodiment can be a process for initializing hydroprocessing. The process can include controlling an amount of hydrogen at a temperature of about 420-about 470° C. that may be added to a hydrotreated effluent depending on a temperature in a hydrocracking zone.

The embodiments disclosed herein can modify a hydrogen quench of the hydrocracking catalyst beds so that rather than only adding hydrogen at a cooler temperature after operation has been initialized, heated hydrogen can be added at a higher temperature. This heated hydrogen can help raise the cracking bed temperatures to obtain suitable conversion, so that generally the beds are not solely reliant on the upstream heat from the hydrotreating zone. This can prevent yield loss in the hydrocracking zone due to low feed temperatures. Thus, severe operations in the hydrocracking zone are usually not required. Operating the hydrocracking beds at a suitable severity can prolong catalyst life. Also, the quench stream can remain active enhancing safety. It can also maintain a desired hydrogen to hydrocarbon ratio, which can also prolong catalyst life.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and nonaromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^{+}$ or $C3^{-}$, which is inclusive of the abbreviated one or more hydrocarbons. As an example, the abbreviation "$C3^{+}$" means one or more hydrocarbon molecules of three carbon atoms and/or more. Also, the term "stream" can include or consist of other fluids, such as a hydrogen.

As used herein, the term "rich" can mean an amount of at least generally about 50%, and preferably about 70%, by mole, of a compound or class of compounds in a stream.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "hydroprocessing" can refer to processing one or more hydrocarbons in the presence of hydrogen, and can include hydrotreating and/or hydrocracking.

As used herein, the term "hydrocracking" can refer to a process breaking or cracking bonds of at least one long-chain hydrocarbon in the presence of hydrogen and at least one catalyst into lower molecular weight hydrocarbons.

As used herein, the term "hydrotreating" can refer to a process including contacting a hydrocarbon feedstock with hydrogen gas in the presence of one or more suitable catalysts for the removal of heteroatoms, such as sulfur, nitrogen and metals from a hydrocarbon feedstock. In hydrotreating, hydrocarbons with double and triple bonds may be saturated, and aromatics may also be saturated, as some hydrotreating processes are specifically designed to saturate aromatics.

As used herein, the term "catalytically limited" can refer to a process, such as hydrotreating, having one or more parameters limited by, e.g., the catalyst utilized. As an example, typically new or regenerated catalyst placed in a hydrotreating zone may change characteristics if a temperature in the hydrotreating zone is exceeded. Hence, the hydrotreating zone may be operated not to exceed this temperature until the catalyst reaches equilibrium. After reaching equilibrium, the temperature may be raised although the process may be limited at a higher temperature or other process parameter.

As used herein, the term "cascade control" can refer to a control system used to maintain a proper temperature. A cascade control generally makes use of multiple control loops that involve multiple inputs to manipulate and control a single variable, such as, herein, temperature. Use of cascade control as disclosed herein can allow a system to be more responsive to disturbances in temperature.

As depicted, the process flow lines in the figures can be referred to interchangeably as, e.g., lines, pipes, feeds, branches, effluents, portions, products, or streams.

BRIEF DESCRIPTION OF THE DRAWING

The FIGURE is a schematic, cross-sectional depiction of an exemplary apparatus.

DETAILED DESCRIPTION

Referring to the FIGURE, an exemplary hydroprocessing apparatus 10 can include a hydrotreating zone 100, a hydrocracking zone 200, and an effluent line 140 communicating the hydrotreating zone 100 to the hydrocracking zone 200. Hydrogen can also be provided to the effluent line 140 by a recycled gas heater hydrogen stream 300 and/or a recycled gas compressor hydrogen stream 350, as discussed hereinafter.

Usually, a hydrocarbon feed 30 is provided to the hydrotreating zone 100. The hydrocarbon feed may have components boiling above about 285° C., such as an atmospheric gas oil, a vacuum gas oil boiling between about 315-about 565° C., a deasphalted oil, a coker distillate, a straight run distillate, a pyrolysis-derived oil, a high boiling synthetic oil, a cycle oil, a hydrocracked feed, a catalytic cracker distillate, an atmospheric residue boiling at or above about 340° C., and a vacuum residue boiling above about 510° C. Often, hydrogen can be combined with the hydrocarbon feed 30 before entering the hydrotreating zone 100. Often, the hydrotreating zone 100 is comprised of a hydrotreating reactor 110, which contains one or more hydrotreating catalyst beds 120, which in this exemplary embodiment can be a single bed 120.

Suitable hydrotreating catalyst for the catalyst bed 120 can be conventional hydrotreating catalyst and include those that may be comprised of at least one metal of groups 8-10 of the periodic table, preferably iron, cobalt and nickel, and at least one metal of group 6 of the periodic table, preferably molybdenum and tungsten, on a high surface area support material, such as at least one of silica, alumina, silica-alumina, magnesia, zirconia, boria, and titania, preferably alumina.

Other suitable hydrotreating catalysts can include zeolitic catalysts, as well as noble metal catalysts where the noble metal may be selected from palladium and platinum. More than one type of hydrotreating catalyst can be used in the hydrotreating reactor 110. The metal of groups 8-10 is typically present in an amount ranging from about 2-about 20%, by weight, and the metal of group 6 is typically in an amount ranging from about 1-about 25%, by weight.

During initializing, the operating temperature of the catalyst bed 120 is typically limited to a temperature of no more than about 390° C. until catalytic equilibrium is reached, so that the temperature of the effluent stream 140 is also limited. This catalytic limitation can be up to about 21 days from the beginning of initializing, and further can be up to about 60 days from initializing.

Generally, the hydrocracking zone 200 operates at a higher temperature than the effluent stream 140, typically a temperature exceeding about 400° C. The hydrocracking zone 200 may have a hydrocracking reactor 210, which can operate under any suitable set of conditions and contain one or more hydrocracking catalyst beds 220, which in this exemplary embodiment can be a single bed 220.

The hydrocracking catalyst bed 220 can contain a catalyst including at least one metal component, such as a metal of groups 8-10, e.g., iron, cobalt, nickel, and/or platinum, and a group 6 metal, such as molybdenum, and/or other metals such as magnesium, and a suitable refractory inorganic oxide carrier, such as alumina and/or silica. A suitable hydrocracking catalyst is disclosed in, e.g., U.S. Pat. No. 8,062,509.

After undergoing hydrocracking, a product stream 230 can exit the hydrocracking zone 200. The temperature of the effluent stream 140 can be adjusted, during initialization and operation, by at least one of a pair of gas streams and accompanying equipment.

At least one of the recycled gas heater hydrogen stream 300 (may be referred to herein as "stream 300" or "heated hydrogen stream 300") and recycled gas compressor hydrogen stream 350 (may be referred to herein as "stream 350" or "cooler hydrogen stream 350") can be provided to the effluent. Both streams may include hydrogen and be preferably rich in hydrogen. The stream 300 can be obtained from a recycled gas heater and provided to the suction of a recycled gas heater compressor 310. The stream 300 can be at a temperature of about 420-about 470° C., and typically not exceeding about 470° C. The stream 350 can be derived from a recycled gas compressor 360. The stream 350 can be a hydrogen stream adjusted to a temperature of about 40-about 110° C. Respective pressure indicators 330 and 370 can measure the pressure from the discharge of respective compressors. Generally the stream 300 is hotter than the stream 350, and optionally these streams 300 and 350 may be combined as a stream 160 before being provided to the effluent stream 140. A pressure indicator 390 can measure the pressure of the combined stream 160. Generally, the pressure of the combined stream 160 may range from about 7,800-about 15,000 KPa and the hydrogen to hydrocarbon ratio with respect to the effluent stream 140 can be about 500-about 1,800 $Nm^3/m^3$.

During the operations of the hydroprocessing apparatus 10 while the hydrotreating catalyst is still limited, typically within 60 days from restarting operations, both streams 300 and 350 may be provided to the effluent stream 140. The amounts of each stream may be regulated by a control system including a control valve 340 for the stream 300, a control valve 380 for the stream 350, a cascade controller 400, and a temperature indicator controller 410 in the hydrocracking catalyst bed 220. A sufficient amount of the combined gas stream 160 can be provided and added to the effluent stream 140 to raise the temperature of the effluent to at least about 400° C. before the effluent stream 140 enters the hydrocracking zone 200. The relative amounts of each stream 300 and 350 can be regulated by the cascade controller 400. The temperature indicator controller 410 can be in communication with the cascade controller 400, and in turn in communication with the control valves 340 and 380. The cascade controller 400 can be the master controller regulating the temperature of the hydrocracking catalyst bed 220 by changing the respective set points for the flow of streams 300 and 350. Secondary loops correspond to the change in set points by opening and closing valves 340 and 380 for changing the amounts of hydrogen flowing in respective streams 300 and 350. As each stream 300 and 350 is at a different temperature, the combined stream temperature 160 can be changed depending on the temperature in the hydrocracking catalyst bed 220 so that a sufficient amount of hydrogen can be added at the desired temperature to raise the hydrocracking temperature.

The additional heat can facilitate hydrocracking reactions by helping raise the temperature of the hydrocracking catalyst bed 220 to a suitable level to reach conversion without relying on the upstream heat from the hydrotreating zone 100 as the sole source of heat. Facilitation of the hydrocracking reactions within the hydrocracking catalyst bed 220 can safely eliminate poor conversion and yield loss in the hydrocracking zone 200 until hydrotreatment catalyst is no longer limited and reaches equilibrium. Once the hydrotreatment catalyst reaches equilibrium and the temperature of the hydrotreating zone 100 is no longer limited, a motor operated valve 320 can close blocking the flow of the heated hydrogen stream 300. The cooler hydrogen stream 350 may continue to be provided to the hydrocracking zone 200 as a quench. As such, the heat required to heat the effluent stream 140 from the hydrotreating zone 100 over about 400° C. to facilitate reactions in the hydrocracking zone 200 can be provided by the hydrotreating zone 100. Hence, the cooler hydrogen stream 350 may act as a quench for the hydrocracking zone 200 to prevent excessive temperature in the hydrocracking zone 200. The temperature indicator controller 410 via the cascade controller 400 can regulate the flow of quench gas by opening and closing the control valve 380. Continuing the quench can allow the hydrocracking catalyst bed 220 to operate at a correct level of severity that can lengthen the service life of the hydrocracking reactor 210.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for initializing hydroprocessing, comprising:

A) providing a hydrocarbon feed to a hydrotreating zone wherein the hydrotreating temperature is catalytically limited;

B) passing an effluent from the hydrotreating zone to a hydrocracking zone;

C) adding a gas to the effluent wherein the gas has a higher temperature than the effluent for raising the temperature of the effluent for facilitating hydrocracking reactions; wherein the gas comprises hydrogen and the hydrogen added to the effluent from the hydrotreating zone is obtained from at least one of a recycled gas heater at a temperature of about 420-about 470° C. and a recycled gas compressor at a temperature of about 40-about 110° C.; and D) regulating relative amounts of the hydrogen added to the effluent from the hydrotreating zone from the recycled gas heater and from the recycled gas compressor with a temperature indicator controller communicating with a first control valve and a second control valve for regulating the relative amounts of hydrogen from the recycled gas heater and the recycled gas compressor, respectively, added to the effluent from the hydrotreating zone based on a temperature in a downstream hydrocracking zone.

2. The process according to claim 1, wherein the hydrotreating zone contains a catalyst comprising at least one metal of groups 6 and 8-10 of the periodic table.

3. The process according to claim 2, wherein the catalyst comprises nickel and molybdenum or cobalt and molybdenum.

4. The process according to claim 2, wherein the catalyst further comprises a carrier, in turn comprising at least one of silica, alumina, silica-alumina, magnesia, zirconia, boria, and titania.

5. The process according to claim 1, wherein the hydrotreating zone is operated at a temperature no more than about 390° C.

6. The process according to claim 1, wherein the hydrocracking reactions occur in a hydrocracking zone operated at a temperature at least about 400° C.

7. The process according to claim 1, wherein the catalytic limitation is up to about 60 days from initiating operations.

8. The process according to claim 1, wherein the catalytic limitation is up to about 21 days from initiating operations.

9. The process according to claim 1, wherein a sufficient amount of hydrogen is provided to raise the temperature of the effluent from the hydrotreating zone to at least about 400° C. to effect hydrocracking reactions.

10. The process according to claim 1, further comprising blocking the flow of hydrogen having a temperature of about 420-about 470° C. once catalytic limitations expire.

* * * * *